United States Patent [19]

McAllister

[11] Patent Number: 4,589,236

[45] Date of Patent: May 20, 1986

[54] GEOMETRIC FRAME ASSEMBLY

[76] Inventor: Jack G. McAllister, 805 Montrose Blvd., Buffalo, Minn. 55313

[21] Appl. No.: 617,318

[22] Filed: Jun. 5, 1984

[51] Int. Cl.[4] ..... E04B 1/32

[52] U.S. Cl. ..... 52/81; 52/109; 52/745; 403/174; 403/178

[58] Field of Search ..... 52/80, 81, 86, 109, 52/745; 403/174, 178

[56] References Cited

U.S. PATENT DOCUMENTS

| | | | |
|---|---|---|---|
| 3,057,119 | 10/1962 | Kessler | 52/86 |
| 3,710,806 | 1/1973 | Kelly | 52/81 |
| 3,757,476 | 9/1973 | Schoen | 52/109 |
| 3,888,056 | 6/1975 | Kelly | 52/81 |
| 4,277,922 | 7/1981 | McAllister | 52/81 |

FOREIGN PATENT DOCUMENTS

| | | | |
|---|---|---|---|
| 900902 | 7/1962 | United Kingdom | 52/81 |

*Primary Examiner*—Henry E. Raduazo

[57] ABSTRACT

A geodesic frame assembly and method of making a frame assembly with a plurality of identical hub assemblies interconnected with flexible struts. The hub assemblies have rotatable members connected to ends of the struts. The struts are attached to the members along chord lines so the members rotated during erection of the frame assembly. A cable operably connected to a winch cooperates with outer hub assemblies to erect the frame assembly and hold the frame assembly in the erected configuration.

29 Claims, 12 Drawing Figures

Fig. 1
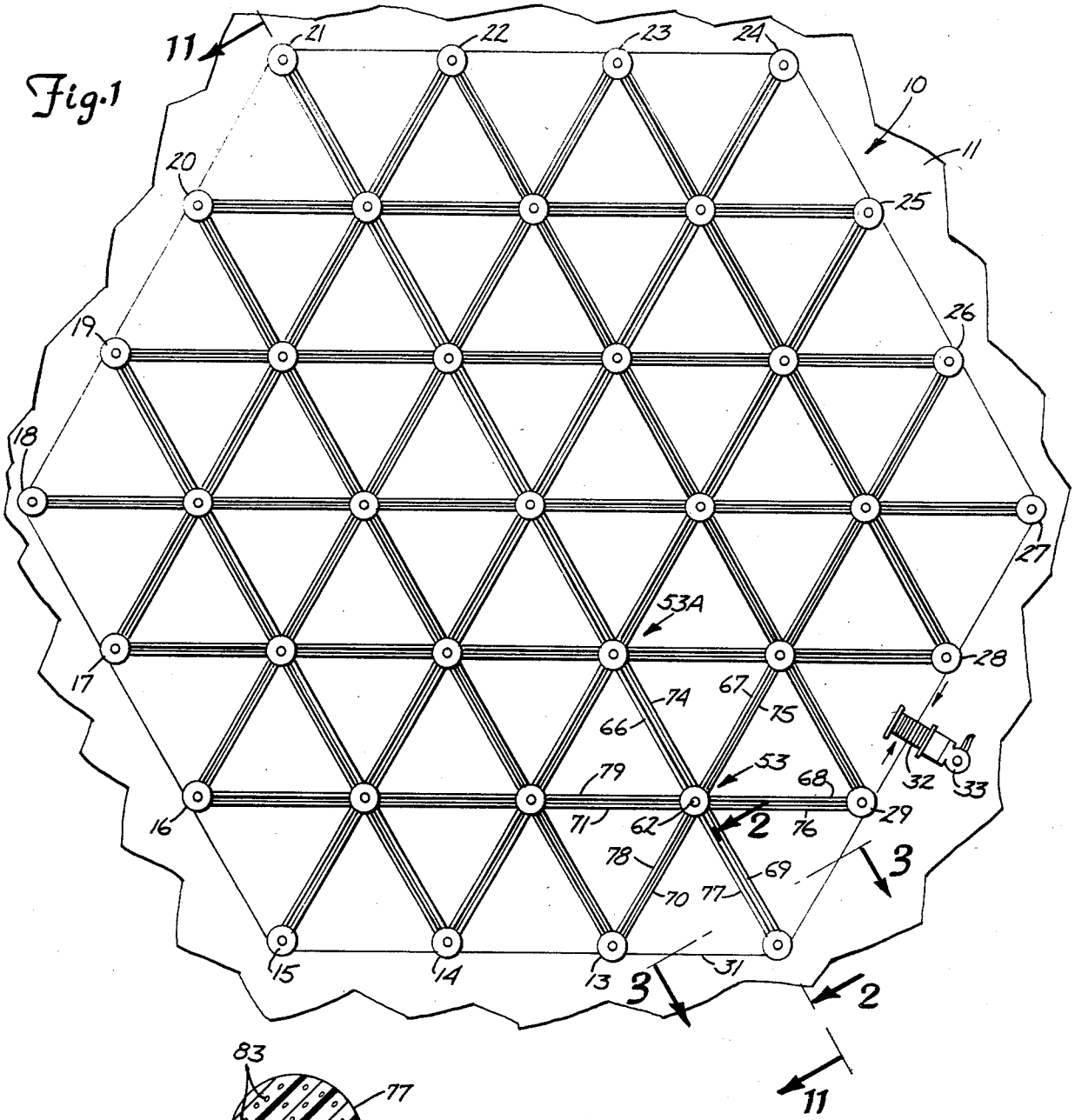
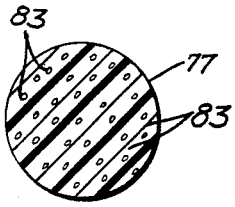
Fig. 8
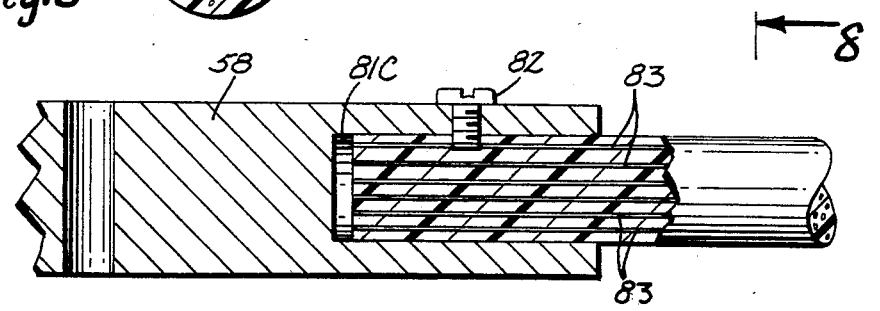
Fig. 7

GEOMETRIC FRAME ASSEMBLY

BACKGROUND OF INVENTION

Geometric structures have frames that support fabric covers and panels. The normal procedure in building a geometric structure is to add the panels around the periphery of an initial center section. The center section is progressively lifted with a lift structure as additional panels are attached around the periphery. McAllister, in U.S. Pat. No. 3,676,976, discloses a method of making a convex structure utilizing a fluid impervious means and a frame structure. Fluid under pressure is supplied to the impervious means to raise the convex curved shape of the frame structure. The curved shape of the frame structure is maintained by the frame structure after the fluid has been exhausted from under the fluid impervious means.

Frame assemblies and method of erecting a frame assembly into a geometric configuration are disclosed by McAllister in U.S. Pat. Nos. 3,973,370 and 4,190,990. The frame assembly has a plurality of elongated members that are adapted to be longitudinally extended from a contracted position to an elongated position. The frame assembly is initially constructed in a flat ground level position with the elongated members in their contracted position. The frame assembly is raised by extending the elongated members. This is accomplished with the use of fluid under pressure or spring biasing members.

McAllister in U.S. Pat. No. 4,277,922 discloses a frame assembly and method of making the frame assembly. The frame assembly has the plurality of strut assemblies connected to hubs. The outer strut assemblies are joined to anchors. Each strut assembly has a spring strut that is biased to a curved contracted position and retained there with a holding member. The frame assembly is erected by releasing the holding members of each of the strut assemblies to allow the strut assemblies to spring to their naturally elongated positions. Once the frame assembly has been erected, it is difficult to collapse the frame assembly as the holding means is not suitable for biasing the struts back to their curved contracted positions.

SUMMARY OF INVENTION

The invention relates to a frame assembly located over a ground level surface and a method of erecting the frame assembly above the surfaces into a geometric configuration. The frame assembly has a network of interconnected struts and hub assemblies. The hub assemblies and struts throughout the frame assembly are identical in construction whereby the entire frame assembly is made from a minimum of different parts. The hub assemblies and struts can be readily assembled and disassembled with a minimum of time and labor.

The struts are elongated flexible rods that are connected at their opposite ends to adjacent hub assemblies. The rods are preferably pultruded fiber reinforced plastic. The fibers, such as glass fibers, are longitudinally oriented along the length of the strut. The struts may be tubular plastic or metal members.

The hub assemblies each include first and second members rotatably mounted on pivot means. A spacer, such as a pulley, is interposed between the first and second members. The ends of the struts are secured to the first and second members in a position such that the longitudinal axis of the strut is offset with respect to the diameter of a member. All of the struts attached to a member have offsets in the same direction so that when forces are applied to the struts, the member will rotate in one direction. The struts attached to the second member have longitudinal axes that are offset from a diameter of the second member. The offset is opposite the offset of the struts in the first member. This causes the second member to rotate in an opposite direction from the first member when the struts are subjected to a contracting force. The outer strut assemblies are concurrently moved toward the center of the structure of effect an erection of the frame assembly. This is accomplished with the use of a cable that applies a simultaneous contracting force on all of the outer hub assemblies. The cable is attached to a winch driven by a motor to apply a contraction force on the outer hub assemblies. The cable can be unwound from the winch whereby the outer hub assemblies will move to their extended position thereby collapsing the frame assembly.

When the frame assembly is located on its support surface, it can be taken apart and readily transported to a new location. The assembly of the frame assembly is done on ground level thereby eliminating the use of erecting structures, such as scaffolding. Special skills are not required to assemble and disassemble the frame assembly as all of the struts and hub assemblies are identical. The layout of the frame assembly is a pattern of equilateral triangles which eliminate special knowledge and mathamatics in order to assemble and erect the frame assembly. The frame assembly is adaptable to a variety of shapes including hexagonal, square, rectangular and triangular.

DESCRIPTION OF DRAWING

FIG. 1 is a top view of a hexagonal layout of the geometric frame assembly of the invention before the frame assembly is erected.

FIG. 7 is an enlarged sectional view taken along the line 7—7 of FIG. 4;

FIG. 8 is an enlarged sectional view taken along the line 8—8 of FIG. 7;

DESCRIPTION OF PREFERRED EMBODIMENT

Figure 2:
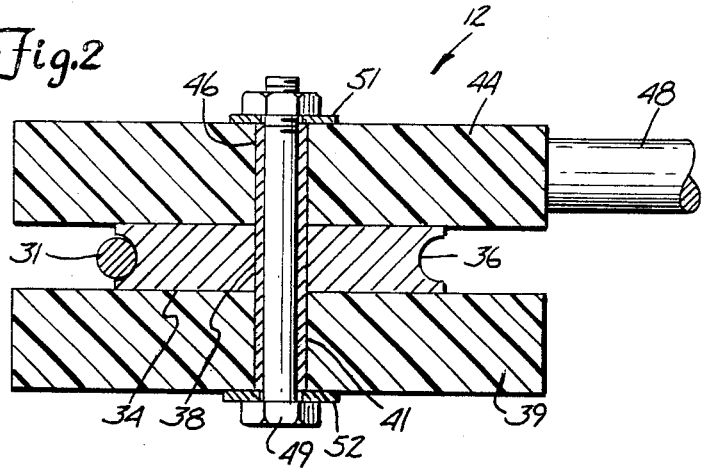
FIG. 2 is an enlarged sectional view taken along the line 2—2 to FIG. 1.

Referring to FIG. 1, there is shown a frame assembly indicated generally at 10 of the invention located on a support surface 11, such as the ground. Frame assembly 10 is illustrated in assembled relation on a flat horizontal support surface 11. Scaffolding and special tools are not required to set up and erect frame assembly 10. Frame assembly 10 is a coherent geometric framework of flexible struts joined to rotatable hub assemblies. The struts and hub assemblies are located in an equilateral triangular pattern as shown in FIG. 1. The frame assembly 10 is assembled in a generally flat position on support surface 11. The outer hub assemblies are moved inwardly to change the shape of the frame assembly 10 from a planar configuration to an erected dome configuration.

Frame assembly 10 has a plurality of first or outside hub assemblies 12 to 29 located around the outer periphery of the frame assembly. A cable 31 associated with each of hub assemblies 12–29 is used to erect frame assembly 10 and hold it in the erected position. Anchors attached to support surface 11 can be used to hold frame assembly 10 in its erected dome position. Winch 32 can slide on surface 11 or can be attached to surface 11. Cable 31 is connected to a winch 32 powered with a motor 33, such as an electric motor. Winch 32 operates to wind up cable 31 thereby draw hub assemblies 12–29 inwardly toward the center of frame assembly 10. This causes frame assembly 10 to change shape from the planar configuration to the erected dome configuration. Winch 32 is also operable to unwind cable 31 thereby allowing frame assembly 10 to move from the dome configuration back to the planar configuration. Winch 32 can be operated with a hand crank.

Figure 3:
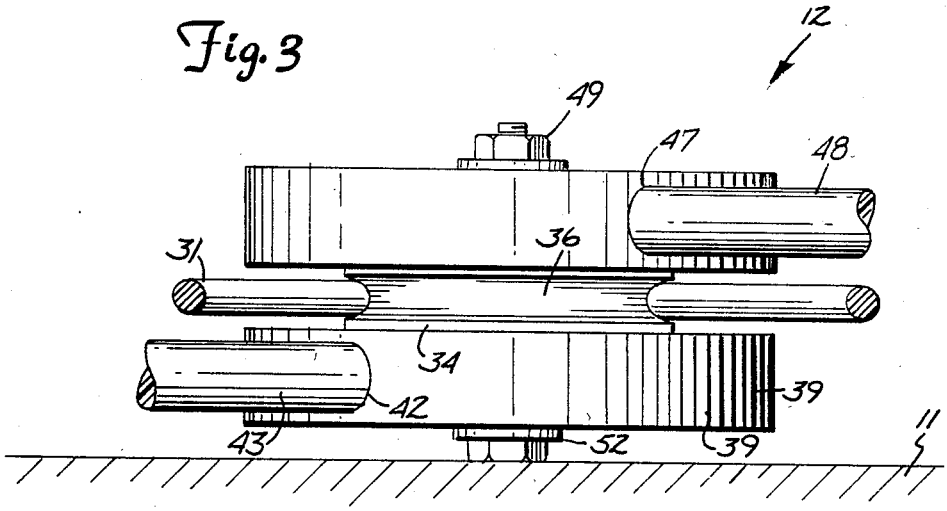
FIG. 3 is an enlarged sectional view taken along the line 3—3 of FIG. 1.

Referring to FIGS. 2 and 3, hub assembly 12 is shown in detail. Hub assemblies 13 to 29 are identical in the structure to hub assembly. Hub assembly 12 has a pulley 34 with a continuous outer groove 36 for accommodating cable 31. Pulley 34 is rotatably mounted on a pivot member or sleeve 37. Sleeve 37 projects through a center hole 38 in pulley 34. A first member 39 having a central hole 41 is rotatably mounted on sleeve 37 adjacent one side of pulley 34. Member 39 has a pocket or hole 42 accommodating an elongated flexible strut 43. Member 39 can have additional pockets for accommodating flexible struts. A second member 44 having a central hole 46 is rotatably mounted on sleeve 46. Second member 44 has a pocket or hole 47 accommodating an elongated flexible strut 48. Member 44 can have additional pockets for accommodating flexible struts. Members 39 and 44 are identical circular plates having pockets for the struts. The longitudinal axes of pockets 42 and 47 are offset from diameters of the plates. In other words, pockets extend along chord lines of the plates. This arrangement allows the plates to rotate during erection of frame assembly 10. Pulley 34 is a spacer located between first and second members 39 and 44. A nut and bolt assembly 49 extends through sleeve 37 and cooperate with washers 51 and 52 to maintain members 39 and 44 and pulley 34 in rotatable assembled relation on sleeve 37. Members 39 and 44 located in surface engagement with opposite sides of pulley 34 to reduce bending forces on sleeve 37.

Figure 4:
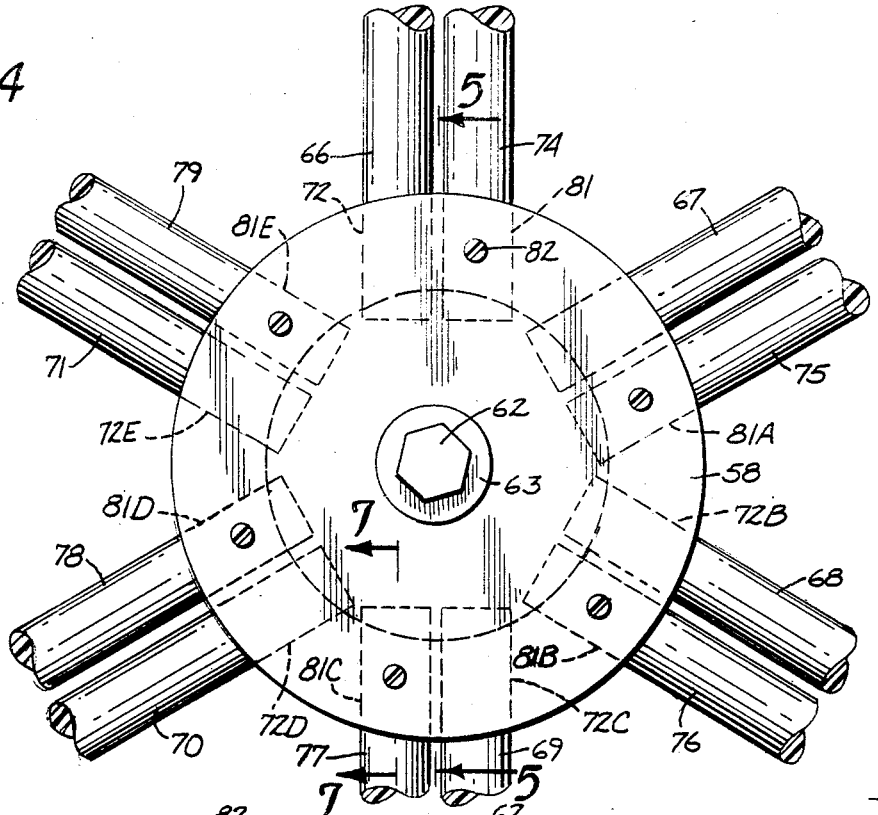
FIG. 4 is a plan view of a hub assembly with the struts attached thereto.
Figure 5:
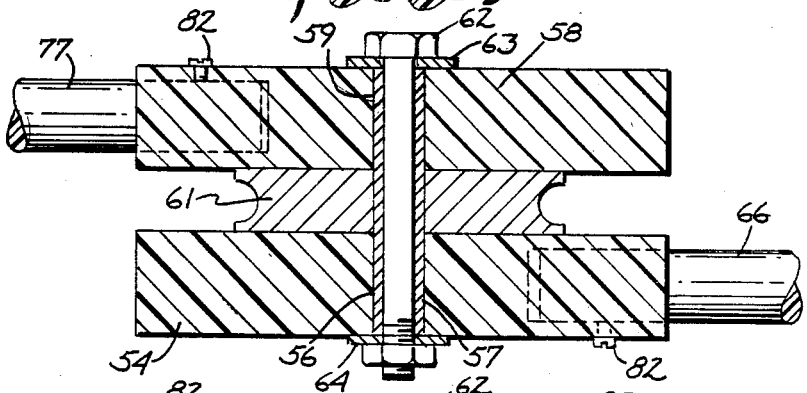
FIG. 5 is a sectional view taken along the line 5—5 of FIG. 4.
Figure 6:
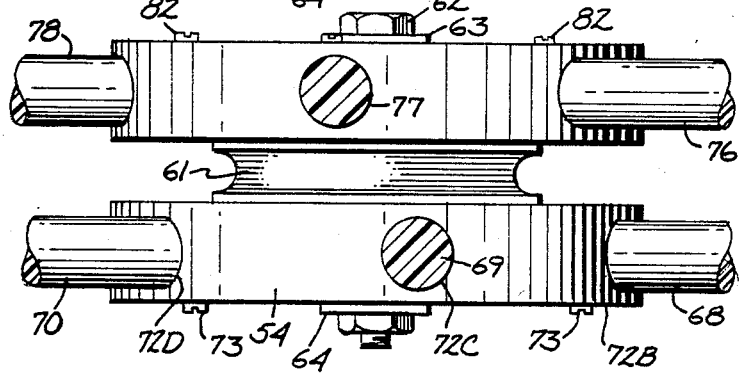
FIG. 6 is a sectional view taken along the line 6—6 of FIG. 4.

Referring to FIGS. 4 to 6, there is shown a second or interior hub assembly indicated generally at 53 used to interconnect the plurality of elongated flexible struts of the frame assembly. All of the interior hub assemblies are identical in structure. The following detailed description is limited to the hub assembly 53. Hub assembly 53 has a first member 54 having a center hole 56 accommodating a pivot member or sleeve 57. A second member 58 having a center hole 59 is rotatably mounted on sleeve 57. A spacer or pulley 61 is interposed between members 54 and 58. A nut and bolt assembly 62 cooperating with washer 63 and 64 hold members 54 and 58 and pulley 61 in rotatable assembled relation on sleeve 59. Members 54 and 58 are held in surface engagement with opposite sides of the pulley 61 to stabilize the hub assembly 53. Members 54 and 58 are identical circular plates rotatably mounted on opposite ends of sleeve 57.

A plurality of struts 66-71 are secured to the first member 54. Member 54 has pockets or holes 72, 72A to 72E. These holes are circumferentially located about the member. All the holes 72, 72A to 72E are offset from the center of member 54 and extend along cords in a counterclockwise direction as viewed in FIG. 4. Struts 67–71 have ends that fit into holes 72, 72A–72E. Fasteners 73, such as bolts or set screws and the like, are used to secure struts 67–71 to the first member 54.

Struts 74–79 are attached to circumferentially spaced portions of second member 58. Member 58 has a plurality of holes 81 and 81A–82E accommodating the ends of struts 74–79. A plurality of fasteners 82, such as bolts, set screws and the like, secure struts 74–79 to member 58. As shown in FIG. 4, six struts are secured to each member 54 and 58. All of the struts are laterally offset or along cord lines with respect to the diameter of members 54 and 58. Struts 74 to 79 are offset in a clockwise direction as viewed in FIG. 4.

All of the struts are elongated linear flexible rods. The struts are identical and the same length. As shown in FIGS. 7 and 8, strut 77 has longitudinally oriented linear fibers 83 embedded within a plastic resin. Fibers 83 are longitudinal linear glass fibers embedded within a rigid elastic plastic resin. The struts are protruded plastic having glass fibers. Other types of fibers, such as polyester and nylon fibers, can be used to reinforce the struts. Struts made of other materials, as tubular steel and tubular plastics can be used in the frame assembly.

Figure 9:
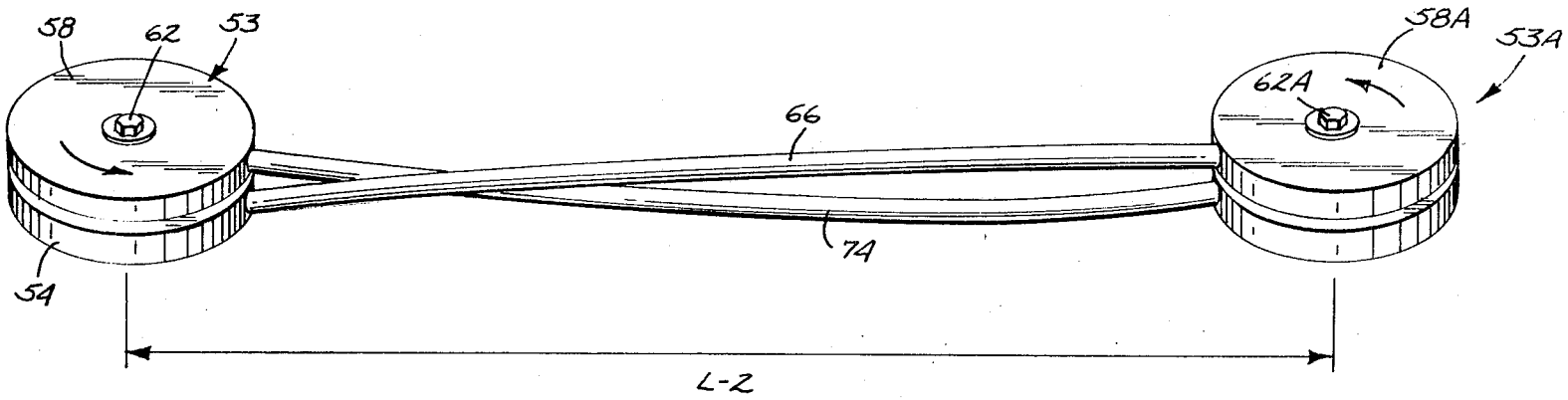
FIG. 9 is a perspective view of adjacent hub assemblies interconnected with crossed elongated struts prior to the erection of the frame assembly.

Referring to FIG. 9, adjacent hub assemblies 53 and 53A are interconnected with elongated linear struts 66 and 74. Struts 66 is attached to first member 54 of hub 53 and the second member **58*a* of the second member 58A of the hub 53A. The second strut 74 is connected to the second member 58 of the hub assembly 53 and the first member 54A of hub assembly 53a. This positions the struts in a crossed relatioship as they extend between hub assemblies 53 and 53A**.

Figure 10:
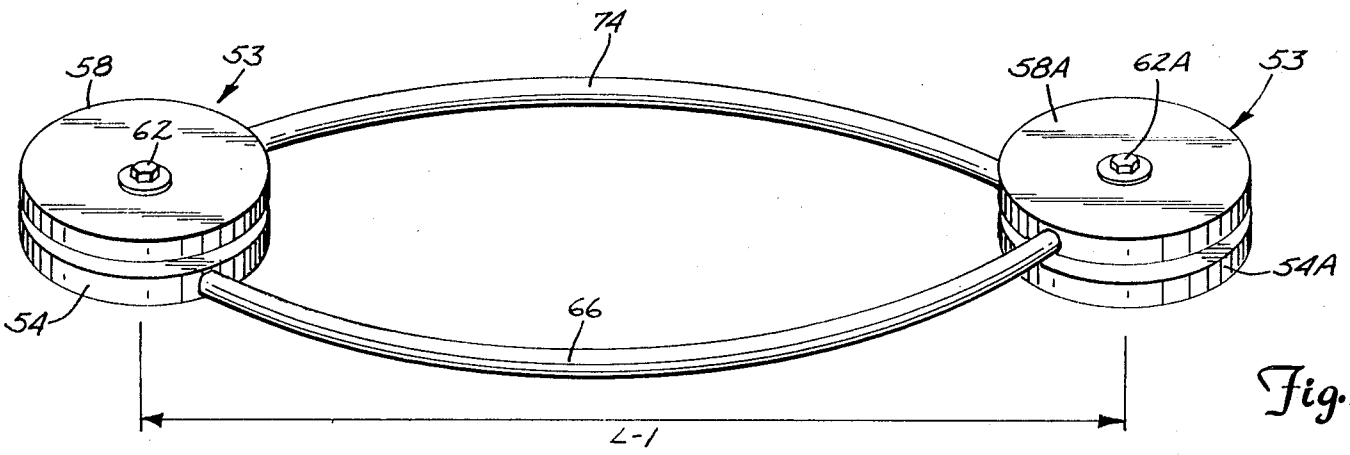
FIG. 10 is a perspective view of adjacent hub assemblies and struts of an erected frame assembly.

Referring to FIG. 10, hub assemblies 53 and 53A interconnected with struts 66 and 74 are shown in their positions when the frame assembly has been erected. Struts 66 and 67 are bowed outwardly in opposite directions. The effective longitudinal distance L2 between hub assemblies 53 and 53A is contracted or shortened as compared to the longitudinal distance L1 between hub assemblies 53 and 53A of FIG. 9. The outward bending of the crossed struts 66 and 67 allows the adjacent hub assemblies to move closer to each other during the erection of the frame assembly 10. The spring or biasing forces of the struts 66 and 67 causes the hub assemblies 53 and struts to move to dome configuration.

Figure 11:
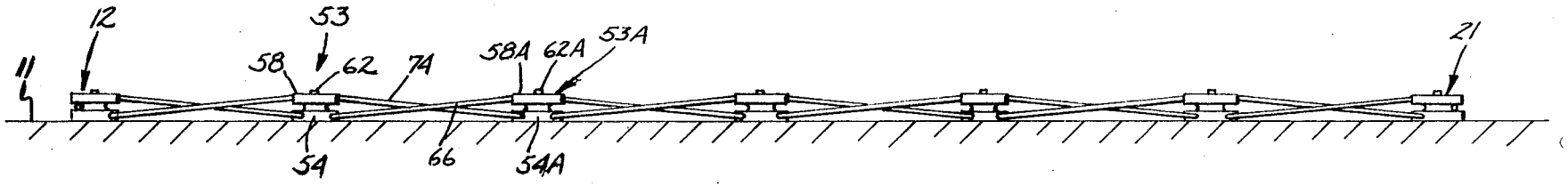
FIG. 11 is an enlarged sectional view taken along the line 11—11 of FIG. 1 showing the adjacent hub assemblies interconnected with the crossed struts prior to the erection of the frame assembly.

As shown in FIGS. 1 and 11, frame assembly 10 is assembled in a flat position on top of surface 11. Struts 66 and 74 are identical for the entire frame assembly. The peripheral hub assemblies 12–29 are identical and equally spaced the perimeter of frame assembly 10. The interior hub assemblies 53 are located in an equilateral triangular relationship relative to each other and peripheral hub assemblies 12–29 as shown in FIG. 1. The geometric arrangement of frame assembly 10 can be assembled in a minimum time and relatively unskilled labor as the struts and hub assemblies are identical with each other. Special tools and erection structures are not used to change frame assembly 10 from a planar configuration shown in FIGS. 1 and 11, to a dome-shaped, as shown in FIG. 12, or other compound curved configurations.

Figure 12:
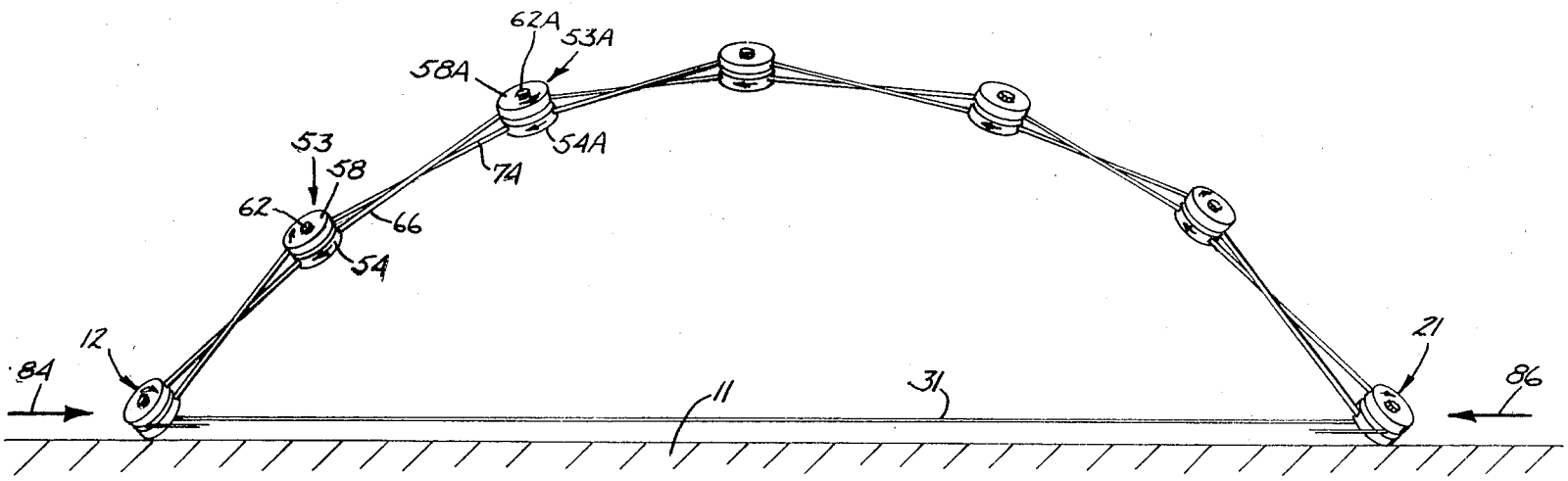
FIG. 12 is a view similar to FIG. 11 showing the frame assembly in the erected position.

The erection of frame assembly 10 from the planar configuration, as shown in FIG. 11, to the dome configuration shown in FIG. 12, is accomplished with the use of cable 31. Winch 32 operated by motor 33 winds up cable 31. This applies inwardly directed forces as shown by arrows 84 and 86 on the outer hub assemblies 12–29. As cable 31 is drawn up by the winch 32, the first and second members of the hub assemblies concurrently rotate in opposite directions and flex the struts to a bowed configuration as shown in FIG. 10. This moves the adjacent hub assemblies closer to each other causing the frame assembly to move upwardly to an erected dome configuration.

The frame assembly can be used to support a fabric cover or roof panels. The hub assemblies function as supports for the fabric roof. Panels can be attached to the hub assemblies to complete the enclosure.

Frame assembly 10 can be collapsed from the dome configuration back to the planar configuration on top of the support surface 11. This is accomplished by operating winch 32 and elongating cable 31. The bowed struts 66–71 will force the adjacent hub assemblies 12–29 and 53 away from each other. This expands the entire frame assembly 10 and causes the frame assembly to move back toward the support surface 11. When frame assembly 10 is located on support surface 10, struts 66–71 can be removed from hub assemblies 12–29 and 53. The entire frame assembly 10 can be taken apart and stored in a compact condition. The compact parts of frame assembly 10 are readily transportable. This is done at the level of the surface 11 or ground level thereby eliminating the use of erecting structures such as scaffolding. Special skills are not required to assemble and disassemble the frame assembly.

The layout of frame assembly 10 is based on a pattern of equal lateral triangles. All of the hub assemblies are identical and all of the struts are of equal length. The hub assemblies and struts are interchangable with regard to their location in the frame assembly 10. The frame assembly 10 has considerable strength in relation to its weight.

The frame assembly 10 shown in the drawing and herein described has a generally circular shape. The struts connected to outer hub assemblies 12, 15, 18, 21, 24 and 27 can be shortened to achieve a more circular perimeter. Other geometric shapes, such as hexagonal, square, rectangular, and triangular can be attained with the hub assemblies and struts that are used to make the frame assemblies.

While there has been shown and described an embodiment of the frame assembly, it is understood that changes in the frame assembly, hub assemblies, and struts may be made by those skilled in the art without departing from the invention. The invention is defined in the following claims.

The embodiments of the invention in which an exclusive property or privilege is claimed are defined as follows:

1. A frame assembly located over a surface comprising: a plurality of hub assemblies arranged in a generally triangular pattern over the surface, each of said hub assemblies having a first member and a second member, means rotatably mounting the first and second members to allow the first and second members to rotate independently of each other, a plurality of flexible struts connected to adjacent hub assemblies, said struts including first struts connected to the first member of one hub assembly along chord lines of the first member and to the second member of another hub assembly along chord lines of the second member, and means cooperating with the hub assemblies, including cable means engageable with the hub assemblies located around the outer perimeter of the frame assembly to hold the hub assemblies and struts in an erected position over the surface.

2. The assembly of claim 1 wherein: the means rotatably mounting the first and second members includes a pivot member rotatably accommodating said first and second members.

3. The assembly of claim 2 including: fastening means holding the first and second members in assembled relation with the pivot member.

4. The assembly of claim 2 including: spacer means located between said first and second members to laterally space the first and second members on the pivot member.

5. The assembly of claim 4 wherein: the spacer means of the outer hub assemblies accommodates the means cooperating with the hub assemblies.

6. The assembly of claim 4 wherein: the first and second members have portions located in surface engagement with the spacer means.

7. The assembly of claim 1 wherein: all of the struts have the same length.

8. The assembly of claim 1 wherein: the struts comprise elongated rods.

9. The assembly of claim 8 wherein: the rods have longitudinally orientation fibers embedded within a plastic resin.

10. The assembly of claim 1 including: means for selectively winding and unwinding the cable means and holding the cable means in a selected position.

11. The assembly of claim 1 wherein: the means rotatably mounting the first and second members includes a pivot member, and spacer means mounted on the pivot member, and spacer means mounted on the pivot member, said first and second members located adjacent opposite sides of the spacer means, said spacer means of the hub assemblies located around the outer perimeter of the frame assembly having means accommodating the cable means.

12. A frame assembly located over a surface comprising: a plurality of hub assemblies positioned on a surface, each of said hub assemblies having rotatable means, said rotatable means including a first rotatable member and a second rotatable member, a plurality of flexible struts connected to the rotatable means of adjacent hub assemblies, said struts including first struts connected to the first rotatable member and second struts connected to the second roratable member, said struts being connected to said first and second rotatable members along chord line off set from the axes of rotation of the first and second rotatable members, and means cooperating with the hub assemblies including cable means cooperating with the hub assemblies located around the outer perimeter of the frame assembly to hold the hub assemblies and struts in an erected position over the surface.

13. The assembly of claim 12 wherein: including a single pivot member rotatably accommodating each of said first and second rotatable members.

14. The assembly of claim 12 wherein: spacer means located between each of said first and second members to laterally space the first and second members.

15. The assembly of claim 14 wherein: said spacer means on the hub assemblies located around the outer perimeter of the frame assembly accommodating said cable means.

16. The assembly of claim 15 including: means for selectively winding and unwinding the cable means and holding the cable means in a selected position.

17. The assembly of claim 16 including: means for selectively winding and unwinding the cable means and holding the cable means in a selected position.

18. The assembly of claim 12 wherein: all of the struts have the same length.

19. A method of making a frame assembly over a surface comprising: arranging on the surface a plurality of hub assemblies having rotatable means, connecting the rotatable means of adjacent hub assemblies with flexible struts, said struts being connected to the rotatable means along chord lines off set from the axes of rotation of the rotatable means, and applying an inwardly directed force to the hub assemblies located around the outer perimeter of the frame assembly to move adjacent hub assemblies toward each other thereby causing the struts to bow and moving the adjacent hub assemblies upwardly from the surface erecting the frame assembly to a dome configuration.

20. The method of claim 19 wherein: the hub assemblies are arranged in an equilateral triangular pattern on said surface.

21. The method of claim 19 wherein: the rotatable means includes a first rotatable member and a second rotatable member, said struts having first struts and second struts, said method including connecting the first struts to the first rotatable member, and connecting the second struts to the second rotatable member.

22. The method of claim 21 wherein: the struts are connected to their respective rotatable members along chord lines offset from the axes of rotation of the first and second rotatable members.

23. The method of claim 22 including: crossing pairs of struts between adjacent hub assemblies.

24. A frame assembly located over a surface comprising: a plurality of hub assemblies arranged in a generally triangular pattern over the surface, said hub assemblies including outer hub assemblies located around the frame assembly, each of said hub assemblies having a first member and a second member, means rotatably mounting the first and second members to allow the first and second members to rotate independently of each other, said means including a pivot member rotatably accommodating said first and second members, spacer means located between first and second members to laterally space said first and second members on the pivot member, a plurality of flexible struts connected to adjacent hub assemblies, said struts including first struts connected to the first member of one hub assembly along chord lines of the first member and to the second member of another hub assembly along chord lines of the second member, and means cooperating with the spacer means of the outer hub assemblies to hold the hub assemblies and struts in an erected position over the surface.

25. The assembly of claim 24 including: fastening means holding the first and second members in assembled relation with the pivot member.

26. The assembly of claim 24 wherein: all of the struts have the same length.

27. The assembly of claim 24 wherein: the struts comprise elongated rods.

28. The assembly of claim 24 wherein: the means cooperating with the spacer means of the outer hub assemblies includes cable means located around the outer perimeter of the frame assembly to hold the hub assemblies and struts in an erected position.

29. The assembly of claim 28 including: means selectively winding and unwinding the cable means and holding the cable means in a selected position.

* * * * *